United States Patent [19]

Vinod

[11] Patent Number: 4,925,707

[45] Date of Patent: May 15, 1990

[54] TREATMENT OF CARPETS

[75] Inventor: Yashavant V. Vinod, Hockessin, Del.

[73] Assignee: E. I. Du Pont de Nemours and Company, Wilmington, Del.

[21] Appl. No.: 136,035

[22] Filed: Dec. 21, 1987

[51] Int. Cl.[5] ..... B05D 3/02

[52] U.S. Cl. ..... 427/393.4; 427/322; 427/422; 427/430.1

[58] Field of Search ..... 427/422, 430.1, 393.4, 427/322

[56] References Cited

U.S. PATENT DOCUMENTS

| | | | |
|---|---|---|---|
| 3,835,071 | 9/1974 | Allen et al. | 252/545 |
| 4,501,591 | 2/1985 | Ucci et al. | 8/495 |
| 4,552,692 | 11/1985 | Gillespie | 252/528 |
| 4,579,762 | 4/1986 | Ucci | 428/95 |
| 4,592,940 | 6/1986 | Blyth et al. | 428/96 |
| 4,668,406 | 5/1987 | Chang | 427/393.4 X |
| 4,678,595 | 7/1987 | Malik et al. | 252/174.17 |
| 4,680,212 | 7/1987 | Blyth et al. | 428/97 |
| 4,681,790 | 7/1987 | Fong | 427/393.4 X |
| 4,695,497 | 9/1987 | Nagy | 427/393.4 X |
| 4,699,812 | 10/1987 | Munk et al. | 427/393.4 |

FOREIGN PATENT DOCUMENTS

| | | |
|---|---|---|
| 0235980 | 9/1987 | European Pat. Off. . |
| 0235989 | 9/1987 | European Pat. Off. . |

OTHER PUBLICATIONS

Mesitol NBS Product Bulletin T.D.S. #1246/1 (Revised), 8/81.

Textile Month, Oct., 1987, pp. 32–34.

*Primary Examiner*—Bernard Pianalto

[57] ABSTRACT

A significant improvement of stain-resistance is obtained by commercial application of stain-blocker to nylon carpet that is installed, as opposed to immersing or otherwise treating the primary carpet or treating the precursor nylon polymer or fibers earlier during a manufacturing process. There are various methods of application and of increasing stain-resistance of installed carpets.

29 Claims, 1 Drawing Sheet

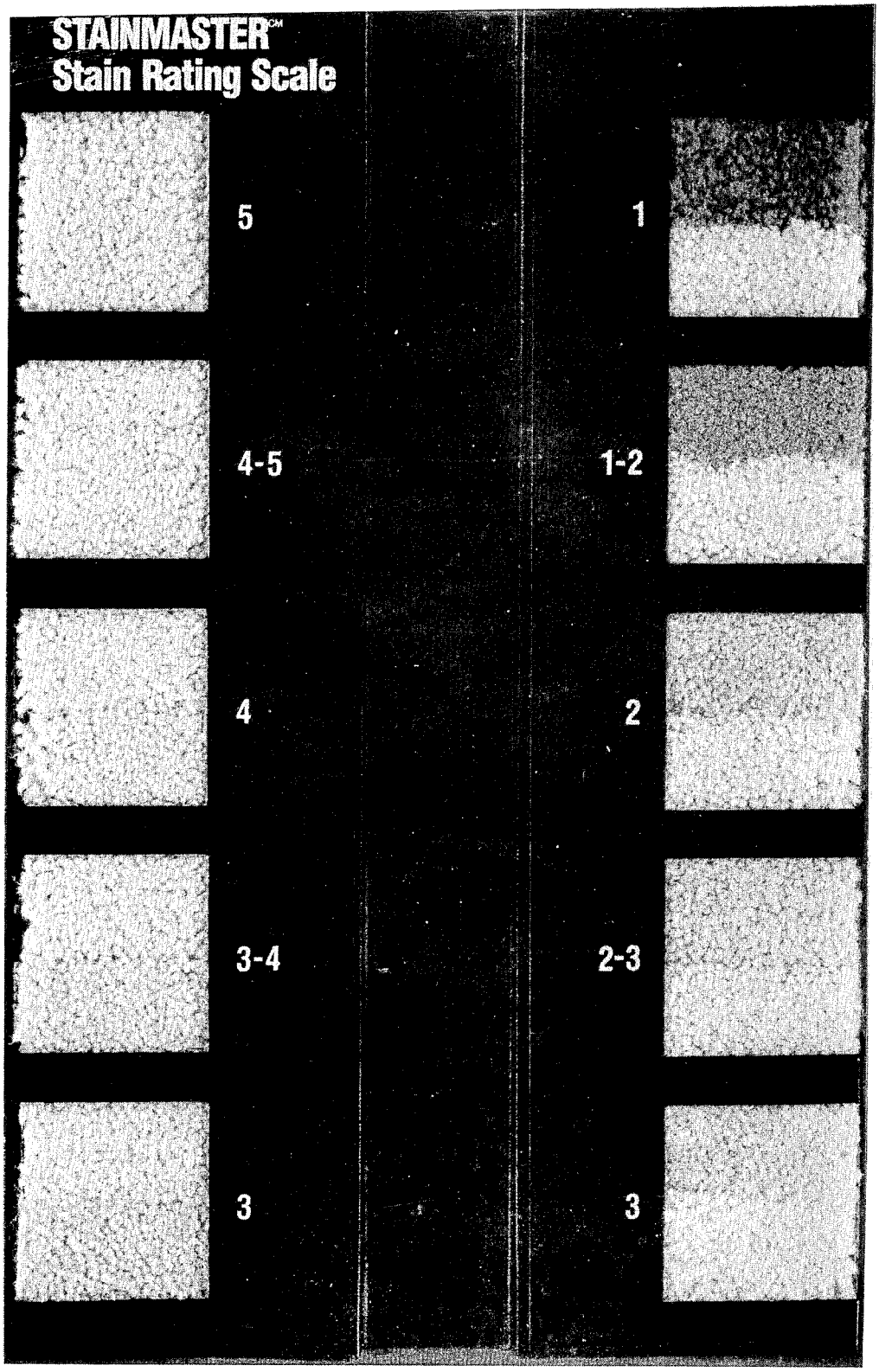
STAINMASTER℠
Stain Rating Scale
5
4-5
4
3-4
3
1
1-2
2
2-3
3

TREATMENT OF CARPETS

FIELD OF THE INVENTION

The present invention concerns improvements in and relating to the treatment of carpets, especially those carpets whose pile fibers comprise polyamide fibers, and is more particularly concerned with a new process that improves their stain-resistance by treatment of the carpets in place.

BACKGROUND OF THE INVENTION

Polyamide fibers (generally referred to as nylon) are preferred fibers for use as pile fibers in carpets, and are used for this purpose both in the form of continuous filament yarns, generally bulked continuous filament yarns, and in various forms as cut fiber, often called staple fiber. For many years, both nylon 66 and nylon 6 have been used in large quantities in carpeting; each polymer has its advantages, for certain purposes; as will be noted herein, nylon 6 has a greater affinity for many dyestuffs than does nylon 66. Although there are many different types of nylon carpeting, a conventional type is manufactured by inserting, e.g., plied nylon yarn into a conventional primary backing, e.g., of jute or polypropylene fibers, and then, after dyeing, applying a conventional carpet backing adhesive composition, sometimes referred to as latex, which is adhered also to a secondary backing material, as described, e.g., for a conventional tufted nylon carpet in Ucci, U.S. Pat. No. 4,579,762, issued Apr. 1, 1986. Another type of secondary backing that is frequently used is a foam-backing, i.e. a layer of, e.g., polyurethane foam that can be attached directly to the primary backing without any need for such adhesive. Generally, especially when using carpeting on flooring, in addition to such primary backing, (any adhesive composition) and secondary backing (all underneath the nylon fiber pile), most householders install a conventional underlay or underpad of felted fibers or foam, e.g. of polyurethane, which conventional underlay is generally an entirely separate layer that is not integrally or overall attached to the carpet per se in the same way as the adhesive backing and secondary backing are integrally attached to the primary backing (carrying the nylon pile that is the top or outer surface of the carpet). During commercial manufacture, when such carpets are dyed, the dyeing process is carried out on the nylon pile when it is attached to the primary backing only, i.e., before (any adhesive latex composition and) the secondary backing is secured to the primary backing, and the dyeing process is carried out in conventional manner, e.g., in a beck dyeing machine, generally by a continuous process in which this primary carpet (i.e., the nylon pile and the primary backing only) is immersed in the dye liquor at the boil so as to effect contact and effective and rapid penetration of the dyestuff into the nylon pile, although there are other methods of coloring nylon, e.g., by producer-dyeing, i.e., including pigmentation into the nylon polymer before spinning.

Recently, there has been major commercial interest in imparting "stain-resistance" to nylon fibers and carpets, as described, for instance, in Textile Month, October, 1987, pages 32–34, and several patents are being published on various aspects of imparting stain-resistance to nylon carpets and/or carpet fibers. A major concern of the customer is the durability of the treatment during the various types of treatment that may be encountered during the life of a carpet.

Munk et al., U.S. Pat. No. 4,699,812, issued Oct. 13, 1987, claims a process for imparting stain resistance to polyamide, wool and silk fibers by contacting the fibers with a solution of an aliphatic sulfonic acid under specified conditions of acid pH and temperature. The primary interest appears to be nylon carpets but the procedure in, e.g., Example 1 shows vigorous mechanical agitation of a woven nylon 6 fiber "sleeve", in an aqueous solution of a commercial aliphatic sulfonic acid, at a pH adjusted to 2, and at a temperature of 50° C., for 15 minutes, followed by drying with paper towels and in an oven. Variants may be used, at a manufacturing stage prior to the finished product, such as is often done in carpet manufacture; immersing the fabrics, removing excess solution by passing through rollers, and air-drying of the moist fibers at ambient temperature is mentioned; spraying onto the carpet is also mentioned; in particular, the treatment may be during or immediately subsequent the dyeing stage (column 4). Example VII shows that treatment at a pH of 3.8 shows far less improvement in stain resistance than treatment at a pH of 2. Accordingly, a pH between about 1.5 and about 3.0 is said to give more effective results (column 3, lines 56–7). Example III shows that the stain resistance (of Example I) remains after vigorous agitation for 15 minutes at 50° C. in an aqueous detergent solution at a pH of 9.5, rinsing and oven-drying.

Blyth et al., U.S. Pat. No. 4,680,212, issued July 14, 1987, discloses a process of applying a spin finish to nylon fibers during the melt polymerization process by which the fibers are prepared, the finish containing one or more stain blocker(s) in specified amounts. Stain blockers are described and distinguished from fluorochemicals that are used to reduce the tendency of soil to adhere to the fiber. Fluorochemicals are used, however, in combination with a stain-blocker, to improve the durability of stain-resistance imparted by the stain-blocker, in the sense that the carpet retains more stain-resistance after being subjected to much traffic.

Blyth et al., U.S. Pat. No. 4,592,940, issued June 3, 1986, discloses a process of immersing a carpet in a boiling aqueous solution of a selected phenol-formaldehyde condensation product at an acid pH (4.5 or less). The durability of treated carpets is tested variously, including by subjecting carpet samples to two wash cycles in a heavy-duty washing machine using detergent before applying the stain.

Ucci, U.S. Pat. No. 4,579,762, issued Apr. 1, 1986, is referred to above, and claims a carpet having a primary backing coated with an adhesive composition (containing a fluorochemical) and with a pile of nylon fibers (the nylon polymer being modified to contain aromatic sulfonate units). In other words, the stain-resistance is obtained by incorporating stain-resistance into the nylon polymer itself, by chemical modification. The vulnerability of the typical carpet system to water, and the problems caused by the slow process of drying are emphasized in the lower portion of column 1, and at the top of column 2.

Ucci et al., U.S. Pat. No. 4,501,591, issued Feb. 26, 1985, claims a process for imparting stain-resistance during a process for continuously dyeing a carpet, involving adding a silicate and a sulfonated phenol- or napthol-formaldehyde condensation product to the aqueous dye liquor at specified liquor ratios, and then subjecting the carpet to an atmosphere of steam, washing with water and drying. The pH of the liquor in the only Example is 4.5, but is said typically to be in the range of 4.5 to 8 (column 3, lines 22–3). Durability is tested by carrying out a Stain Resistance Test on 5 cm ×5 cm carpet samples alternating with heavy duty cleaning using Streamex (Steamex) commercial units. Ucci, like others, disparages (column 1, lines 46–59) the prior usage of fluorochemicals to minimize staining.

Greschler et al., EP Al 0235989, published Sept. 9, 1987, and corresponding to copending Application S.N. 900,490, filed Aug. 26, 1986, discloses a process for applying sulfonated phenol- or naphthol-formaldehyde condensation products to nylon carpets, after dyeing, in a bath at a pH of between 1.5 and 2.5, whereby yellowing of the treated articles due to exposure to $NO_2$ is reduced.

Mesitol NBS is mentioned by Greschler as a commercially available material (available from Mobay Chemical Corporation). This is stated in Product Bulletin T.D.S. #1246/1 (Revised) Aug. 1981, to be an anionic after treating agent and a reserving agent to minimize the staining by selected direct dyes of the polyamide portion in polyamide cellulosic fiber blends, and the "Application Procedures" indicate that the fabric should be treated in a bath. It is understood that stain-blockers are dye-resists or dye-reserving agents such as have long been known and widely used in textile applications, such as resist-printing of nylon fibers. In other words, the mechanism of stain-blocking (in the sense of dye-reserving) has been used for many years.

As indicated in the above patent specifications, and in the analysis in the Oct. 19, 1987, issue of Textile Month, referred to above, hitherto, the emphasis on process techniques, as regards imparting stain-resistance, has been reported to achieve this during the dyeing of the primary carpet, or earlier in the manufacturing process, e.g., by incorporation of modifiers into the nylon polymer, or by engineering or treatment of the fiber itself. So far as is known, prior to the present invention, it had not been disclosed that a significant improvement in stain-resistance could be effective when applied to "in place" carpet that had already been installed with any appropriate secondary backing, and normally also an underpad, as opposed to conventional immersion of the primary carpet in a dye liquor or equivalent application, usually under acid conditions, followed by conventional processing, such as washing, fixing, squeezing, and appropriate drying treatments at elevated temperatures during a manufacturing process.

SUMMARY OF THE INVENTION

I have now found, according to the present invention, that a significant improvement in stain-resistance may be effected by applying stain-blockers to installed carpets, in contrast with the immersion or other manufacturing treatments that have been referred to, and that the results of this in place treatment have been acceptable to a surprising extent.

Accordingly, there is provided, according to the invention, a process of imparting stain-resistance to an installed nylon carpet by a process that includes the steps of treating the installed nylon carpet, especially a carpet of nylon 66 fiber, by applying thereto a stain-blocker in sufficient amount and in such manner as to obtain a significant improvement in stain-resistance, and of allowing the treated carpet to dry in the atmosphere.

The process of the invention is described in more detail and with preferred embodiments hereinafter, and is expected to have considerable commercial significance, as will be described. For instance, a preferred commercial application is expected to be by overall treatment by appropriately-trained personnel to obtain the type of professional appearance that a customer normally expects. This is expected to be especially useful when applied as a supplement to stain-resist and/or soil-resist treatments that have already been applied during the manufacturing process, as described in the prior art referred to already. However, overall treatment of carpets that have not been treated with stain-blocker (during manufacture or otherwise) is also feasible, and may prove useful, also. These types of overall treatment, to give an appearance that is commercially acceptable, is generally to be preferred in contrast with spot or localized treatments such as may result from application topically to an installed carpet by use of a spray can. However, as will be seen, spot cleaning with detergents may affect the durability of stain-resist performance, so that certain topical applications to installed carpets may be advantageous, depending on circumstances.

I was surprised to discover that a significant improvement and a satisfactory commercially-satisfying appearance could be obtained by the process of the invention, i.e., application to an installed carpet, (especially to deep pile carpets with a pile height of about ¼-inch or more, more particularly ½-inch, or ¾-inch or more) since there has been a prejudice in the trade against this technique and in favor of application during the manufacturing process, as indicated hereinbefore, e.g., by Ucci.

BRIEF DESCRIPTION OF THE DRAWING

The file of this patent contains at least one drawing executed in color. Copies of this patent with color drawing(s) will be provided by the Patent and Trademark Office upon request and payment of the necessary fee.

The FIGURE is a color photograph to show the Stain Rating Scale that was used herein.

DETAILED DESCRIPTION OF THE INVENTION

The treating step must be carried out in such manner and with stain-blocker in sufficient amount that a significant improvement in stain-resistance is obtained. I believe that a significant increase in stain-resistance will be readily apparent to a skilled person with the aid of a suitable test. As will be recognized by those experienced in the treatment of nylon carpets, however, the precise treatment conditions that may be necessary will depend on the nature of the carpet, e.g., its construction (various features being mentioned herein), the type of nylon fiber used, and the stain-resistance of the nylon fibers in the pile before commencing the treatment. Experience in determining suitable conditions can be obtained empirically in conjunction with the information contained herein, especially in the Examples. Stain-resistance may be determined, if desired, by any of a number of published tests, but herein, stain-resistance levels are measured according to Stain Test 1, unless stated otherwise. Generally, the starting carpet (i.e., the carpet before treatment) will be treated because it is considered to have insufficient stain-resistance. As will be shown hereinafter, however, detergent-cleaning and wear can reduce the stain-resistance of a carpet, at least so far as the durability of the stain-resistance is concerned. Accordingly, even if a starting carpet already passes a recognized test for stain-resistance, an improvement in stain-resistance, at least in the sense of the durability of the stain-resistance, may be obtained by in-place treatment with stain-blocker as described herein (it being understood, however, that it may be undesirable to build up too much coating of stain-blocker, e.g. for aesthetic reasons). However, for most purposes, according to the present invention, since a starting carpet will generally have inadequate stain-resistance, as can be shown by a stain-rating of 4 or less (as described hereinafter with regard to Stain Test 1, with staining for 30 minutes) a significant improvement in stain-resistance can be demonstrated for the purposes of the present invention by improvement from such a stain-rating of 4, to a stain-rating of 5. As will be shown in some Examples, however, it is possible to improve carpets by using the process of the invention from even lower starting stain-ratings, and such more effective treatments are generally preferred. For instance, a much improved stain-resistance can be shown using a longer staining time of 24 hours for Stain Test 1, and improving from a stain-rating of 4 to 5, and treatments to obtain this are preferred. Once appropriate treatment conditions have been established for any particular type of carpet, using as starting carpet a sample having a low stain-rating, and improving to the desired high stain-rating, preferably of 5, and thus determining that a significant improvement in (or much improved) stain-resistance is obtainable using such conditions, including the amounts of stain-blocker and conditions for that particular type of carpet, equivalent treatment conditions may be applied, according to the invention, including to starting carpets having a higher stain-rating, and even a stain-rating or 5, so as to improve the durability of the stain-resistance by treatment according to the invention. Thus, as indicated, although other staining tests may be perfectly satisfactory, and even preferred by some operators or for certain purposes, for ease of understanding and consistency throughout the remainder of this specification, it will be understood that references to stain-ratings herein will be to this Stain Test 1.

STAIN TEST 1

In this standardized Stain Test 1, each carpet specimen is first stained and then spot cleaned by hand in an attempt to remove the stain, and the various samples are then compared. As will be apparent, essentially the same procedure is used, but the duration of the staining period may be increased so as to increase the severity of the staining test. The staining agent is cherry-flavored, sugar-sweetened Kool-Aid® (sold commercially), mixed in amount 45 gms (±1) of Kool-Aid® in 500 ccs water, and allowed to reach room temperature, i.e., 75° F. (±5) or 24° C. (±3), before using.

The specimen is placed on a flat non-absorbent surface, 20 ml of Kool-Aid® are poured onto the carpet specimen from a height of 12 inch (30 cm) above the carpet surface, and the specimen is then left undisturbed for a staining period that may be, e.g., 5 min., 30 min. or 24 hours, according to the desired severity of the test. (Although the 5 min. staining period is not referred to in the Examples herein, earlier tests have used a staining period as short as this.)

Excess stain is blotted with a clean white cloth or clean white paper towel or scooped up as much as possible, without scrubbing. Blotting is always performed from the outer edge of spill in towards the middle to keep the spill from spreading. Cold water is applied with a clean white cloth or a sponge over the stained area, gently rubbing against the pile from left to right and then reversing the direction from right to left. The excess is blotted.

A detergent cleaning solution (15 gms (±1) of TIDE detergent mixed in 1000 cc of water, and also allowed to reach room temperature before using), is applied with a clean white cloth or a sponge directly to the spot, gently rubbing the pile from left to right and then reversing the direction from right to left. The entire stain is treated, all the way to the bottom of the pile, and then the blotting is repeated.

The cold water treatment is repeated, and the carpet is blotted thoroughly, to remove the stain and also the cleaning solution, so the carpet does not feel sticky or soapy.

The cold water and detergent cleaning steps are repeated until the stain is no longer visible, or no further progress can be achieved. The carpet is blotted completely to absorb all the moisture.

The stain-resistance of the carpet is visually determined by the amount of color left in the stained area of the carpet after this cleaning treatment. This is referred to as the stain-rating, and is herein determined according to the Stain Rating Scale (that is illustrated in the FIGURE, being a photograph of a Stain Rating Scale) that is currently used by and available from the Carpet Fibers Division of E. I. du Pont de Nemours and Company, Wilmington, Del. 19898. These colors can be categorized according to the following standards:

5 = no staining
4 = slight staining
3 = noticeable staining
2 = considerable staining
1 = heavy staining In other words, a stain-rating of 5 is excellent, showing excellent stain-resistance, whereas 1 is a bad rating, showing persistence of heavy staining. As will be understood, and shown hereinafter in the Examples, even an improvement in stain-rating from 1 to 3 (after a 30 min. staining period) shows a significant increase in stain-resistance. As can be seen from the Stain Rating Scale, a dramatic difference in color is shown by changes in stain-rating at these low levels, while it is recognized that it is generally more difficult to improve stain-ratings above 4.

Suitable stain-blockers that may be used according to the invention include those described in Blyth et al., U.S. Pat. No. 4,680,212, and the sulfonated condensation products described (as stain-resist agents) in Greschler et al., EP Al 0235 989, and the improved materials, being acetylated or etherified sulfonated phenol-formaldehyde condensation products referred to in EP Al 0235 980, published Sept. 9, 1987, and corresponding to copending application Ser. No. 943,335, filed Dec. 31, 1986, in the name of Liss (directed to synthetic polyamide textile substrates, such as carpeting, treated with such improved condensation products, so as to impart stain-resistance to the substrate without suffering from a yellowing problem associated with prior art materials) and also the compositions listed in copending Applications (references CH-1536 and CH-1458), filed simultaneously herewith, all of which are hereby included by reference herein. To avoid any misunderstanding, a staining agent itself is not regarded as a "stain-blocker" (as the term is used herein) as the objective is to achieve stain-resistance and to avoid or minimize color changes in the carpet, as a result of treatments according to the invention.

As indicated in the Background above, and in the prior art referred to, the term stain-resist agent has sometimes been used broadly to include fluorochemicals that should be and are herein more correctly described as soil-resist agents, whereas the term stain-blocker has been and is herein used more narrowly to exclude soil-resist agents that do not have the capability of resisting staining by red food dyes such as found in Kool-Aid®, e.g. Red Dye No. 40.

In addition to treatment of the installed nylon carpet with a stain-blocker, in accordance with the present invention, the durability of the stain-resistance may be improved by treatment of the installed carpet with a compound to improve the anti-soiling characteristic, especially a fluorochemical (sometimes referred to as a stain-resist agent) as described in Blyth et al., U.S. Pat. No. 4,680,212 and herein, and in the other references that are mentioned herein, and that are incorporated herein.

As described herein, and more particularly in the Examples, different materials may be applied in combination, being applied from a common aqueous or other carrier, or separately.

As described more particularly hereinafter, in the Examples, the efficacy of the stain resistance that is imparted is generally, improved by improving the overall distribution and opportunity for contact between the nylon fibers and the materials applied, especially by achieving thorough and essentially uniform overall wetting of the nylon fibers, especially reaching down to impart stain-resistance to the base of the pile fiber, as far as will be visible, during normal wear, and when the pile fibers are parted for any reason. This is generally and most conveniently achieved by applying an aqueous detergent solution to achieve the desired objective of overall and thorough wetting of the nylon pile fibers, and preferably by mechanical working to improve contact, distribution and penetration, e.g., by a pile brush operated by hand or automatically, for instance using a cleaning device such as may be available commercially. Application of a detergent solution may conveniently be achieved by first cleaning the carpet, e.g., using a cleaning machine that is commercially available with a detergent that is sold for such purpose, especially if the carpet is initially in soiled condition, and then, while the carpet fibers are still in moist condition, the stain-blocker (and fluorochemical stain-resist agent, if desired) may be applied and preferably worked into the carpet. However, as indicated hereinafter, good results have also been achieved by applying the stain-blocker together with a detergent.

As indicated, it will generally be desirable to apply materials in such way as to avoid or minimize shade changes and spotty results, such as would result from inappropriate and/or uneven application. However, as indicated elsewhere, spot cleaning or other topical-type cleaning can reduce the stain-resistance that has already been imparted to nylon fibers, and so can remove some of the effectiveness of any existing stain-blocker on the fibers, and this may make it desirable to apply spot or other topical applications to achieve as uniform and overall result as possible on the installed carpet. It will be understood that the term overall is used herein in contrast to spot or localized applications.

An essential feature of the present invention, as it will be applied in commercial practice, is treatment of the installed carpet in place, i.e., without removal of the carpeting from the floor or whatever location is normal (although it will be understood that, for testing purposes, e.g., in the laboratory, carpets and samples of carpeting can and will be treated in other locations), as opposed to treatment cf a carpet (or precursor nylon fiber or even polymer) by a stain-blocker by immersion or otherwise during a manufacturing process. Accordingly, depending on the location of the installed carpet, and the surrounding environment, it will generally be desirable to use appropriate conditions and precautions, e.g., limiting the amount of water, since drying of the treated carpet will generally not be so easily achievable as during a manufacturing process. However, an advantage of treatment of an installed carpet is that (depending on the convenience of the owner of the carpet) the stain-blocker may be left in contact with the nylon fibers for a longer period, overnight, or even over a weekend, than would be practical in most manufacturing processes. This feature means that some limitations that may have been applicable in practice to limit the use of potential known dye-resist agents (as potential stain-blockers) may not apply for use according to the present invention, and broadens the scope of applicability of the present invention to other stain-blockers that have not been used hitherto in the manufacturing process. It is of the essence of the present invention that the treated carpet cannot be dried in an oven, as have teen the case after application of stain-blockers in a manufacturing process. Accordingly, the treated carpet is allowed to dry in the air, but it will generally be preferable to assist the drying of the treated carpet by blowing hot air through the pile of the installed carpet. As indicated, it will generally be desirable to allow the stain-blocker to remain in contact with the nylon fibers in moist condition for several hours, e.g., at least six hours, and preferably overnight, before completing the drying of the treated carpet, e.g., by blowing hot air.

As can be seen from the Examples herein, significant improvements in stain-resistance have been obtained according to the invention by treatment with stain-blocker at normal to alkaline pH values, e.g., from pH values of about 7 up to about 11. This is contrary to what has been indicated in the art, where emphasis has been on the advantages of applying stain-blockers under acidic conditions, and usually at pH values of less than 5, and sometimes at acidic pH values much less than 5. Although it may be possible to treat the carpets at such acidic pH values, depending on the environment of the installed carpets, the treatment step according to the present invention will generally be preferably carried out at pH values that are not too far from normal, e.g., from about 4 to about 11, even though a value of about 6 or more is generally to be preferred over more acid pH values.

The invention is further illustrated in the following Examples, in which all parts and percentages are by weight, o.w.f. is estimated weight of indicated active ingredient on weight of (nylon face) fiber, and the nylon is 66 nylon, unless otherwise indicated, and approximate metric equivalents are given.

EXAMPLE I

A bcf (bulked continuous filament) nylon 1110-68 yarn, i.e. 1110 denier (1235 dtex) and 68 filaments (of trilobal cross-section), was produced by a conventional process. Two of these yarns were plied and twisted to produce a yarn having a balanced twist of 4.5 tpi (turns per inch, 1.8 turns per cm). The resulting yarn was then heat-set at 270° F. (132° C.) in a Superba heat-setting machine. A cut pile tufted carpet was constructed from the heat-set yarn and a conventional polypropylene primary backing to the following specifications: - 42 oz/sq yd; ½ inch pile height; 1/10 gauge; 31 stitch rate per 3 inches (1.4 Kg/sq m; 13 mm; ¼ cm; 41/100 cm). This carpet was dyed (to a light beige shade) and finished, using a conventional batch dye process, dye auxilliaries and the following dye formula, based on weight of carpet, 0.011% C.I. Acid Yellow 219, 0.0094% C.I. Acid Red 361, 0.008% C.I. Acid Blue 277 at a pH of 6.5. After dyeing, this carpet was rinsed. A commercial fluorochemical (equivalent to cationic version of Teflon® Toughcoat, available from E. I. du Pont de Nemours and Company, Wilmington, Del. 19898, was applied (0.9% o.w.f.) in a conventional spray application, and the carpet was dried in an oven. A commercially available latex composition (Textile Rubber Co., Calhoun, GA) was applied as a carpet backing adhesive, with a secondary polypropylene backing under the Tradename Actionbac (Amoco, Atlanta, GA).

This "finished carpet" with latex and secondary backing was then used as a specimen for "in place" treatment with a stain-blocker. A 20g/1 solution of an acetylated Mesitol NBS solution as referred to in copending Application S.N. 943,335, mentioned above, was used for the stain-blocker solution (adjusted to pH 5.0 with citric acid) and was uniformily applied at approximately 0.5% of active stain resist o.w.f. by spraying at room temperature (using a Sears brand, 2 gallon (about 7.5 liter) capacity open top sprayer). The sprayed mixture was worked into the pile fiber using a pile brush. The treated carpet was allowed to dry at room temperature.

Samples of the dried carpet were then tested by staining for 30 min., using Kool-Aid®, according to Stain Test 1. Untreated (control) samples of the same carpet, (i.e., without the stain-blocker treatment) were also tested, for comparative purposes. The treated carpet samples showed only a noticeable pink stain on the fiber, after cleaning, i.e. a stain-rating of 3, in contrast to dark red staining (i.e. a stain-rating of 1) on the untreated carpet samples. Although even this stain-rating (3) would not be acceptable for this half inch pile carpet, there was significant improvement in stain-resistance, in comparison with the rating (1) for the untreated carpet, and it will be understood that by changing the treatment conditions for the same carpet, or by applying the same treatment to a different carpet (e.g., with a less dense, shorter pile, Suessen set, staple carpet, providing greater accessibility for the stain-blocker), more effective stain-blocking can be expected, and obtained, as will be seen hereinafter.

A similar result has been obtained by using Mesitol NBS solution itself, i.e. the non-acetylated material, in similar amounts and under similar conditions.

EXAMPLE II

This carpet was similar to that in Example I, except that the yarn was 3.0s (5.1 m/g) cotton count, 3.8 tpi (1.5 turns per cm) and Suessen set at 200° C., and the carpet was 45 oz/sq yd (1.5 Kg/sq m) and 24 stitches per 3 inches (31/10 cm), and Scotchgard Fluorochemical FC 393 was applied instead of the fluorochemical used in Example I. When this carpet was treated with the same stain-blocker and tested under similar conditions as in Example I, it gave only a slight pink stain (rating 4), in contrast to the dark red staining for the untreated carpet.

EXAMPLE III

A sample of the finished carpet, as prepared in Example II, was placed on a padding material (metrix 100, prime urethane carpet cushion of ¼ inch (6 mm) thickness, sold by General Felt Industries & Co.) to simulate the conditions of a typical carpet "in place", for in-home use, and then cleaned with 4 passes of a Chemco brand soil extractor model 60DM, (available from Accommodation Santiary Supply Co., Phila. PA) using Spartan X-Traction II detergent solution (a standard detergent composition also available from Accommodation Sanitary Supply Co.) diluted 1:53 in room temperature water. The damp carpet (estimated 10–20% moisture level) was then sprayed with a mixture containing Teflon® MF (Du Pont brand fluorochemical): acetylated Mesitol NBS, as in Example I: water is 1:1:15 proportions at a pH of 5.0 using a pressurized sprayer, 2 gallon (7.5 liters) capacity (brand name Aconoline, sold by B & G Equipment Co.) in approximate amount of active stain resist estimated to be 1% o.w.f. The sprayed mixture was then worked into the pile fiber using a pile brush as in Example I. The treated carpet was allowed to dry in air an then stain tested as described in Example I, except that the staining solution remained for 24 hours before cleaning. The treated carpet showed no visible stain (stain-rating of 5) compared to untreated carpet (a dark red stain with a stain-rating of 1).

The Example shows the improved effect achieved by uniform distribution of stain resist throughout the pile fiber by spraying the carpet while still moist after detergent-cleaning.

EXAMPLE IV

This is similar to Example III, except that 8 cleaning passes were performed with the Chemico soil extractor, the cleaning detergent solution consisted of 1 part of the Spartan X-Traction II detergent mixed with 0.2 parts of the same stain-blocker as in Example I, with a resultant pH of 7.5, and the approximate amount of active stain resist was estimated to be 0.8% o.w.f. This treated carpet showed no visible stain (stain rating of 5) compared to untreated carpet (a dark stain with a stain rating of 1).

This Example shows effective distribution of a stain-blocker throughout the pile fiber by cleaning a carpet with a detergent solution containing the stain-blocker.

EXAMPLE V

A commercial or contract type carpet was used instead of the residential carpet constructions in the earlier Examples. Du Pont Antron XL, 1280 denier (1420 dtex) fiber with a hollow cross-section was used for this carpet. The construction specifications were 40 oz/sq yd (1.4 Kg/sq m), 5/16 inch (8 mm) pile height, dyed to earth-tone beige color, using leveling acid dyes followed by the same fluorochemical as in Example I. The carpet was then latexed and glued down on a linoleum padding. The carpet was placed in a corridor and subjected to wear for 178,000 foot traffic cycles. The carpet was then cleaned with Clarke's heavy duty steam extraction unit model Ext-20 (available from Advance Paper Co., Wilmington, DE) and dried at room temperature. The dried carpet was then sprayed with the same stain-resist solution at room temperature in the same way as explained in Example I, except the active stain resist was approximately 1.7% o.w.f., the sprayed mixture being worked in using a pile brush. Samples of the dried carpet were then stained for 30 min. by Stain Test 1. The treated carpet showed no stain (stain-rating of 5) compared to untreated carpet (a dark stain with a stain-rating of 1).

EXAMPLE VI

The starting carpet was a finished carpet (nylon staple cut pile, 40 oz/sq yd, (1.4 Kg/sq m) ½ inch (13 mm) pile height, beck dyed to light beige shade, latexed and secondary backed) that had already been mill-processed with an effective amount of the stain-blocker used in Example I during manufacturing, and had been stain tested using Stain Test 1 (24 hours) to show a visual stain-rating of 5. This carpet was then subjected to 344,000 foot traffic cycles.

The trafficked carpet was cleaned using a detergent and a Stanley Steemer (Dublin, Ohio) truck mount unit and some of this was dried. The dried carpet was stained for 24 hours and cleaned using Stain Test 1, and now showed noticeable staining (visual stain-rating of 3).

Part of the carpet that was cleaned, but which was still partially damp (estimated to be about 10% moisture level) was oversprayed with the same stain-blocker as in Example I, in a detergent solution (Stanley Steemer #SS76, a standard anionic detergent) at a pH of 7.8 (to a concentration of about 0.4% o.w.f. active stain-resist), followed by Teflone MF fluorocarbon spray application. The sprayer used in this case was a 2 gallon capacity can with Spray System Tip TEEJET 8004 (Spraying System of Almoca Corp., Wynnewood, PA), 40–60 psi and an application height of 12–19 inches above the carpet, 2 passes, one in each direction. This treated carpet was air-dried at room temperature and then stain-tested for 24 hours using Stain Test 1. The carpet showed no visible stain with a stain-rating of 5.

This Example shows that a stain-blocked carpet with a stain performance that has been reduced (stain-rating of 3) because of detergent-cleaning and trafficking, can be restored to its original stain-performance (stain-rating 5) with an in-place treatment as described above.

EXAMPLE VII

A 15 dpf, trilobal cross-section, staple nylon 66 was produced by a conventional process. The yarn was prepared as 3s cotton count, 2 ply balanced twist of 4 turns per inch and Suessen heat set (200° C.). The carpet was constructed with the following specifications: 1/10 inch gauge, 46 oz/sq yd, ½ inch pile height, beck dyed to a light beige shade with the standard dyeing auxilliaries and level acid dyes. After dyeing, the carpet was treated in a bath containing 2.5% o.w.f. of the same stain-blocker as in Example I at 170° F. for 20 min. at approximately 20:1 liquor ratio. The carpet was then rinsed, topically treated with a cationic dispersion of the fluorochemical described in Example 6 of EP A2 172,717, and dried, latexed, cured and tip sheared. The carpet was stain-tested for 24 hours using Stain Test 1 and visually rated at stain-rating of 5. Half this cleaned carpet was re-tested by restaining on part of the same spot for 30 minutes using Stain Test 1. The stain-rating was now slight staining (i.e., a rating of 4). The remaining half of the carpet was sprayed with the same stain-blocker as in Example I at 0.16% o.w.f., and allowed to dry at room temperature. This treated carpet was then stain-tested similarly for 30 minutes using Stain Test 1, to give a stain-rating now of 5 again.

This Example shows that a sample with a reduced stain-performance, because of detergent-cleaning, can be restored to its earlier stain-performance by an in-place treatment.

EXAMPLE VIII

A stain-resist-treated, cut pile saxony carpet was produced from a 13 dpf, bcf, trilobal cross-section (1107 total denier) Superba heat set yarn. The latexed and finished carpet with a secondary polypropylene backing was tested per Stain Test 2 (described below) and was found to have an inadequate stain rating of only 2–3, indicating that the stain-resist-treatment was not satisfactory. The carpet was cleaned with a Chemco brand soil extractor model 60DM (1 pass) with a 1:100 diluted shampoo blend (as disclosed in Example 2 of copending Application (CH-1536), filed simultaneously herewith), and referred to above, at a pH of 7.7 followed by an overspray of a mixture of the 80:20 hydrolyzed styrene/maleic anhydride polymer: acetylated Mesitol NBS, as described in Example 1 of the same copending Application (C -1536): Teflon® MF: water in 1:1:46 proportions (2 passes). The carpet was treated in this manner "in place" at room temperature and was allowed to dry at room temperature. This dried treated carpet showed no visible stain (stain-rating of 5) when tested by Stain Test 2 (24 hours).

The carpet can be treated in this manner by multiple passes, with such a diluted shampoo, followed by an overspray, as described, to improve the stain-rating of a wide range of inadequately stain-resist-treated, or untreated carpets.

STAIN TEST 2

A 6 inch × 6 inch (15 cm × 15 cm) specimen of carpet is placed on a flat non-absorbent surface. 20 ml of the Kool-Aid® solution prepared as for Stain Test 1 described herein is applied to the specimen of carpet by placing a 1-½ inch –2 inch (3.8 cm –5.1 cm) cylinder tightly over the specimen and pouring the Kool-Aid® solution into the cylinder to contact the carpet specimen thereby forming a circular stain. The cylinder is then removed and excess Kool-Aid® solution is worked into the carpet tufts to achieve uniform staining. The stained carpet specimen is left undisturbed for 24±4 hours, after which it is rinsed thoroughly with cool water, squeezed dry, and excess solution removed. The specimens are inspected and evaluated according to the same rating standards as described hereinabove for Stain Test 1.

EXAMPLE IX

This Example illustrates a preferred procedure for treating soiled carpets "in place", regardless whether they may or may not have been first cleaned with an anionic shampoo, which may or may not have contained a stain-resist agent, such carpet having been soiled or trafficked as may happen in normal residential use.

A beige-colored, mill-processed, latexed and secondary backed carpet was made from bcf 2-ply Superba heat set and 38 oz/sq yd (1.3 Kg/sq m) with a finished pile height of about 7/16 inches (11 mm). The carpet was stained using Stain Test 2 and was found to have a stain-rating of 1–2. The carpet was cleaned with a Stanley Steemer truck mount unit (4 passes) using Stanley Steemer #SS76 brand shampoo (pH 8.8). The cleaned carpet was then further cleaned using the same shampoo blend as in Example VIII, but with a final dilution to 1:150 in water and 4 passes, followed by an overspray (2 passes) of the same blend as in Example VIII: Teflon® MF: Water in the same 1:1:46 proportions. The carpet was allowed to dry at room temperature. This dried treated carpet showed no visible stain (stain-rating of 5) when tested by Stain Test 2 (24 hours).

EXAMPLE X

A carpet as described in Example IX has also first been cleaned with a commercial shampoo (predominantly anionic, without cationic materials) and then followed by either (1) cleaning with the same shampoo blend and an overspray as described in Example IX or (2) just the overspray as described in Example IX (but with multiple passes, instead of only 2 passes), or (3) cleaning with anionic shampoo materials containing the stain-blocker, to give satisfactory high stain-ratings.

As indicated, nylon 6 has a greater affinity for many dyestuffs than nylon 66. This means that, for a nylon 6 carpet, a greater amount to stain-blocker may generally have to be used to obtain equivalent improvement in stain-resistance (equivalent to that obtained as shown herein for nylon 66 carpets), or more passes (repeats of the application treatment) may have to be used. This means that more coating may build up on the nylon fiber, and may affect (adversely) the aesthetics of the carpet and face fiber. Accordingly, the treatment of the invention is preferably applied to carpets whose fiber has already received treatment with stain-blocker during manufacture of the carpet and/or fiber, especially, as indicated, for nylon 6.

I claim

1. A process of imparting stain-resistance to an installed nylon carpet, wherein said nylon is selected from the group consisting of nylon 66 and nylon 6 polymers, and the stain-resistance imparted is resistance to staining by an acid dye colorant, by a process that includes the steps of treating the installed nylon carpet by applying thereto a stain-blocker insufficient amount and in such manner as to obtain a significant improvement in stain-resistance, wherein said stain-blocker is selected from the group consisting of sulfonated phenol-formaldehyde condensate polymers, sulfonated naphthol-formaldehyde condensate polymers, and hydrolysed vinyl aromatic-maleic anhydride polymers, and of allowing the treated carpet to dry in the atmosphere.

2. A process according to claim 1, wherein the nylon carpet consists essentially of nylon fiber tufted through a primary backing, and wherein the backing also comprises a secondary backing, and the backings are secured by an adhesive composition.

3. A process according to claim 1, wherein the nylon carpet consists essentially of nylon fiber tufted through a primary backing, and wherein the backing also comprises a secondary backing, and wherein the secondary backing is a layer of foam attached to the primary backing.

4. A process according to claim 1, 2 or 3, wherein the nylon carpet is installed with an underpad.

5. A process according to claim 1, 2 or 3, wherein the nylon carpet has a pile height of about ¼-inch or more.

6. A process according to claim 1, 2 or 3, wherein the nylon carpet has a pile height of about ½-inch or more.

7. A process according to claim 1, 2 or 3, wherein the nylon carpet is of a loop-pile construction.

8. A process according to claim 1, 2 or 3, wherein nylon 66 polymer is used for the nylon fiber in the nylon carpet.

9. A process according to claim 1, wherein the stain-blocker is applied over all to the nylon carpet.

10. A process according to claim 1, 2 or 9, wherein the installed nylon carpet is treated by applying thereto an aqueous solution of a detergent to achieve thorough wetting of the nylon fiber in the pile of the carpet, and is treated with the stain-blocker while the nylon fiber is wetted.

11. A process according to claim 10, wherein the aqueous solution of detergent is applied to the installed nylon carpet simultaneously with the stain-blocker.

12. A process according to claim 10, wherein the aqueous solution of detergent is applied to the installed nylon carpet before applying the stain-blocker.

13. A process according to claim 1, 2 or 9, wherein the installed nylon carpet is first cleaned, and is then treated with the stain-blocker while in moist condition.

14. A process according to claim 13 wherein the nylon fiber, where in the form of polymer, fiber or carpet, has already been treated with a stain-blocker, prior to the process of treating the installed nylon carpet with the stain-blocker according to the process of claim 1, 2 or 9.

15. A process according to claim 1, 2 or 9, wherein the step of treating the installed nylon carpet with the stain-blocker is performed by overall spraying the installed nylon carpet with the stain-blocker when the nylon fiber of the pile of the nylon carpet is in moist condition.

16. A process according to claim 1, 2 or 9, wherein the step of treating the installed nylon carpet with the stain-blocker includes mechanical working of the nylon fiber of the pile of the installed nylon carpet, so as to improve the distribution and contact between the stain-blocker and the nylon fiber of the pile of the nylon carpet.

17. A process according to claim 1, 2 or 9, wherein the drying of the treated carpet is assisted by blowing hot air onto the pile of the installed nylon carpet.

18. A process according to claim 17, wherein at least about six hours delay is observed between the step of applying the stain-blocker to the installed nylon carpet and a step of blowing hot air to complete the drying of the nylon fiber in the pile of the installed nylon carpet.

19. A process according to claim 1, 2 or 9, wherein the installed nylon carpet is treated by applying thereto a fluorochemical soil-resist agent, in addition to the treatment with the stain-blocker.

20. A process according to claim 19 wherein the installed nylon carpet is treated simultaneously with the fluorochemical and the stain-blocker.

21. A process according to the installed nylon carpet the stain-blocker is applied to the installed nylon carpet before applying the fluorochemical.

22. A process according to claim 19 wherein the fluorochemical is applied to the installed nylon carpet before applying the stain-blocker.

23. A process according to claim 1, 2 or 9, wherein the installed nylon carpet is treated with the stain-blocker under normal or alkaline pH conditions.

24. A process of imparting stain-resistance to an installed nylon pile carpet, wherein said nylon is selected from the group consisting of nylon 66 and nylon 6 polymers, and the stain-resistance imparted is resistance to staining by an acid dye colorant, such as Red Dye No. 40, comprising the steps of thoroughly wetting the pile fibers of the installed carpet with an aqueous solution of a detergent, and then applying a stain-blocker to the pile fibers, while wetted with detergent, in sufficient amount and in such manner as to obtain a significant improvement in stain-resistance, wherein said stain-blocker is selected from the group consisting of sulfonated phenol-formaldehyde condensate polymers, sulfonated naphthol-formaldehyde condensate polymers, and hydrolysed vinyl aromatic-maleic anhydride polymers, and allowing the treated carpet to dry in the atmosphere.

25. A process of improving the stain-resistance of an installed nylon pile carpet, wherein said nylon i selected from the group consisting of nylon 66 and nylon 6 polymers, and wherein stain-resistance means resistance to staining by an acid dye colorant, the fibers of said nylon pile having been treated already with stain-blocker, wherein the carpet is cleaned with an aqueous solution of a detergent, and a stain-blocker selected from the group consisting of sulfonated phenol-formaldehyde condensate polymers, sulfonated naphthol-formaldehyde condensate polymers, and hydrolysed vinyl aromatic-maleic anhydride polymers is applied to the carpet, while wetted with the detergent and water, and is mechanically worked into the nylon fibers of the pile of the installed nylon carpet so as to improve the distribution and contact between the stain-blocker and the nylon fibers of the pile of the nylon carpet, the stain-blocker being applied in sufficient amount and in such manner as to obtain a significant improvement in stain-resistance, and allowing the treated carpet to dry in the atmosphere.

26. A process of imparting stain-resistance to an installed nylon pile carpet, wherein said nylon is selected from the group consisting of nylon 66 and nylon 6 polymers, and the stain-resistance imparted to resistance to staining by an acid dye colorant, wherein there is applied to the carpet an aqueous solution of a detergent with a stain-blocker, in sufficient amount and in such manner as to obtain a significant improvement in stain-resistance, wherein said stain-blocker is selected from the group consisting of sulfonated phenol-formaldehyde condensate polymers, sulfonated naphthol-formaldehyde condensate polymers, and hydrolysed vinyl aromatic-maleic anhydride polymers, and the pile fibers are mechanically worked so as to improve the distribution and contact between the stain-blocker and the nylon fibers of the pile of the nylon carpet, the stain-blocker being applied in sufficient amount and in such manner as to obtain a significant improvement in stain-resistance, and allowing the treated carpet to dry in the atmosphere.

27. A process according to claim 24, 25 or 26, wherein the stain-blocker is a sulfonated phenol-formaldehyde condensate polymer.

28. A process according to claim 24, 25 or 26, wherein the stain-blocker is a sulfonated naphthol-formaldehyde condensate polymer.

29. A process according to claim 24, 25 or 26, wherein the stain-blocker is a hydrolyzed vinyl aromatic-maleic anhydride polymer.

* * * * *

UNITED STATES PATENT AND TRADEMARK OFFICE

CERTIFICATE OF CORRECTION

PATENT NO. : 4,925,707

DATED : MAY 15, 1990

INVENTOR(S) : YASHAVANT V. VINOD

It is certified that error appears in the above—identified patent and that said Letters Patent is hereby corrected as shown below:

Claim 1 (col. 13, line 39), "insufficient" to "in sufficient"

Claim 9 (col. 14, line 2), "over all" to "overall"

Claim 14 (col. 14, line 19), "where" to "whether"

Claim 21 (col. 14, line 52), "the installed nylon carpet" to "Claim 19, wherein"

Claim 24 (col. 14, lines 65-66), delete "such as Red Dye No. 40,"

Claim 25, (col. 15, line 11), "i" to "is"

Abstract, line 1, change "of" to "in"

Col. 10, line 36, "Chemico" to "Chemco"

Signed and Sealed this

Twenty-third Day of July, 1991

*Attest:*

*Attesting Officer*

HARRY F. MANBECK, JR.

*Commissioner of Patents and Trademarks*

UNITED STATES PATENT AND TRADEMARK OFFICE

CERTIFICATE OF CORRECTION

PATENT NO. : 4,925,707

DATED : MAY 15, 1990

INVENTOR(S) : YASHAVANT VINAYAK VINOD

It is certified that error appears in the above-identified patent and that said Letters Patent is hereby corrected as shown below:

COL. 7, LINE 47, CHANGE "STAIN-RESIST" TO -- SOIL-RESIST--

Signed and Sealed this

Ninth Day of February, 1993

*Attest:*

STEPHEN G. KUNIN

*Attesting Officer*

*Acting Commissioner of Patents and Trademarks*